US006394016B2

(12) United States Patent
Swartout et al.

(10) Patent No.: US 6,394,016 B2
(45) Date of Patent: May 28, 2002

(54) DEPLOYABLE NET FOR CONTROL OF WATERCRAFT

(75) Inventors: Terry L. Swartout, Largo, FL (US); Kevin Gessner, Midlothian, VA (US)

(73) Assignee: General Dynamics Ordnance and Tactical Systems, Inc., St. Petersburg, FL (US)

( * ) Notice: Subject to any disclaimer, the term of this patent is extended or adjusted under 35 U.S.C. 154(b) by 0 days.

(21) Appl. No.: 09/785,732

(22) Filed: Feb. 16, 2001

Related U.S. Application Data

(60) Provisional application No. 60/183,587, filed on Feb. 18, 2000.

(51) Int. Cl.[7] ..... B63B 21/16
(52) U.S. Cl. ..... 114/254; 114/382
(58) Field of Search ..... 114/242, 253, 114/254, 382; 441/85; 102/356

(56) References Cited

U.S. PATENT DOCUMENTS

| | | | | |
|---|---|---|---|---|
| 1,101,580 A | | 6/1914 | Steinmetz | |
| 1,145,806 A | | 7/1915 | Selby | |
| 1,226,348 A | | 5/1917 | McGray | |
| 1,240,317 A | | 9/1917 | Clark | |
| 1,249,144 A | | 12/1917 | Ludlow | |
| 1,772,888 A | | 8/1930 | Elia | |
| 3,266,423 A | | 8/1966 | Simpson | |
| 3,646,847 A | | 3/1972 | Drew | |
| 4,505,179 A | | 3/1985 | Nelson et al. | |
| 4,640,179 A | * | 2/1987 | Cameron | 87/6 |
| 4,724,768 A | | 2/1988 | Robinson et al. | |
| 4,741,243 A | | 5/1988 | Snider | |
| 4,753,400 A | * | 6/1988 | Reuter et al. | 244/110 R |
| 4,768,417 A | | 9/1988 | Wright | |
| 4,784,035 A | | 11/1988 | Fishfader et al. | |
| 4,912,869 A | | 4/1990 | Govett | |
| 5,069,109 A | | 12/1991 | Lavan, Jr. | |
| 5,396,830 A | | 3/1995 | Kornblith et al. | |
| 5,398,587 A | | 3/1995 | Kornblith | |
| 5,417,139 A | | 5/1995 | Boggs et al. | |
| 5,583,311 A | | 12/1996 | Rieger | |
| 5,750,918 A | | 5/1998 | Mangolds et al. | |
| 5,792,976 A | | 8/1998 | Genovese | |
| 5,898,125 A | | 4/1999 | Mangolds et al. | |
| 5,988,036 A | | 11/1999 | Mangolds et al. | |
| 6,325,015 B1 | * | 12/2001 | Garcia et al. | |

OTHER PUBLICATIONS

Chamberlain, Gary "Computer simulation key to mine–clearing system", *Design News online,* Oct. 23, 1995 http://www.manufacturing.net/magazine/dn/archives/1995/dn1023.95/20news.htm Printed Jun. 5, 2001.

Stark, John "User Story—ADAMS:US NAVY", *Managing CAD/CAM/CAE* Aug. 18, 2000 http://www.johnstark.com/call2.html Printed Jun. 5, 2001.

* cited by examiner

*Primary Examiner*—Sherman Basinger
(74) *Attorney, Agent, or Firm*—William B. Slate; Wiggin & Dana

(57) ABSTRACT

A system and method for the capture of a target surface vessel by a second vessel. The system includes an initially stowed deployable net, means for deploying the net, a tether coupled to the net, and a winch for drawing in the tether to pull the target vessel toward the second vessel.

15 Claims, 5 Drawing Sheets

OPERATIONAL SEQUENCE OF VESSEL CAPTURE SYSTEM

DEPLOYABLE NET FOR CONTROL OF WATERCRAFT

CROSS-REFERENCE TO RELATED APPLICATION

This patent application claims priority of U.S. Provisional Patent Application Serial No. 60/183,587 entitled "DEPLOYABLE NET FOR CONTROL OF WATERCRAFT" that was filed on Feb. 18, 2000, the disclosure of which is incorporated by reference herein.

BACKGROUND OF THE INVENTION (1) Field of the Invention

This invention relates to water-borne vessels, and more particularly to capturing of one vessel by another.

(2) Description of the Related Art

Rocket-deployed net devices have been used for neutralization of mines in shallow water during amphibious assault operations. General Dynamics Ordnance and Tactical Systems, Inc. (formerly Primex Technologies, Inc.) has developed such a system utilizing distributed explosive technology (DET). Each self-contained DET system includes the distributed explosive net and the associated solid propellant rocket motors, a fire control system, launch rails, and a shipping and storage container.

BRIEF SUMMARY OF THE INVENTION

We have adapted this mine neutralization technology to use in capturing vessels. In one aspect, the invention is directed to a system for permitting a first surface vessel to capture a second surface vessel. The system is mounted on the first surface vessel and includes a net having an initial stowed condition. A launcher projects the net from the stowed condition to a deployed condition ensnaring the second vessel at a first location. A winch is coupled to the net via a tether to permit the net to draw the ensnared second vessel from the first location toward a location of the second vessel. Such locations may be either absolute or relative depending upon the particular conditions involved.

In implementations of the invention, the launcher may include first and second chemical rockets such as solid propellant rockets. The rockets may be coupled to a distal portion of the net via a harness system. The net may generally increase in width from a proximal portion to a distal portion when the net is in an unfurled condition. The harness may include left and right portions respectively coupled to the first and second rockets and distributing force supplied by the rockets over a substantial portion of a net leading edge.

The net leading edge may bear a plurality of weights having a specific gravity in excess of one and effective to cause sinking of a distal portion of the net. Exemplary material for the weights includes lead and various nontoxic lead substitutes. For nonlethal use, the net preferably carries no explosive material and is advantageously reusable after deployment. More aggressive systems may have explosive or other offensive components.

In another aspect, the invention is directed to a method for the capture of a target surface vessel by a second vessel. An aforementioned net system is provided on the second vessel. The rockets are launched to deploy the net over the target vessel in a first location. The winch is caused to draw in the tether then pull the target vessel toward the second vessel. The method may include permitting a portion of the net located distally of the target vessel in the first location to sink so as to enhance entanglement of the target vessel in the net. The method may include permitting the target vessel to move from the first position and override a portion of the sunken portion of the net. The method may include permitting the overridden portion of the net to entangle and stop a propeller of the target vessel. The method may further include returning the net to its stowed condition, unwinding the tether from the winch, and replacing or refueling the rockets so as to permit reuse of the system.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
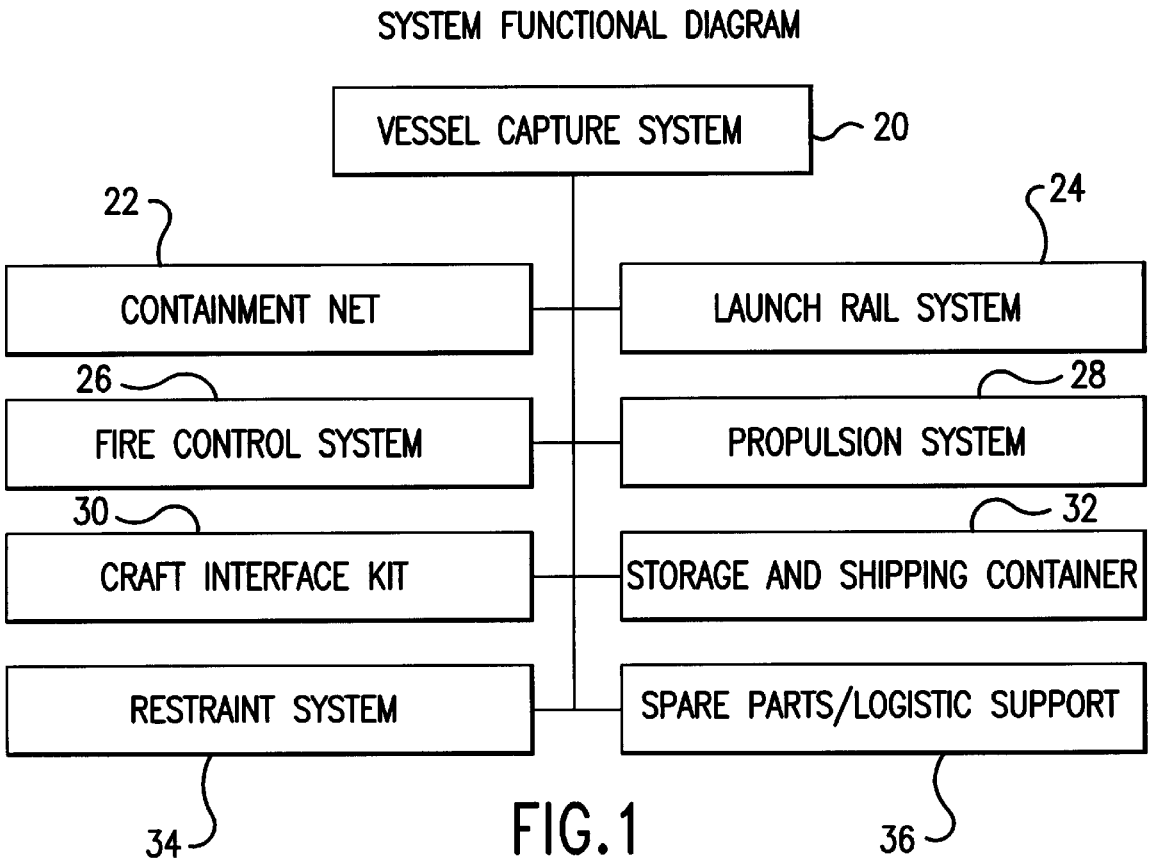
FIG. 1 is a functional diagram of an exemplary vessel capture system.

FIG. 1 shows a functional diagram of a system 20. The system 20 includes a containment net 22, a launch rail system 24, a fire control system (FCS) 26, a propulsion system 28, a craft interface kit 30, a storage and shipping container 32, a restraint system 34, and spare parts and logistic support equipment 36.

Figure 4:
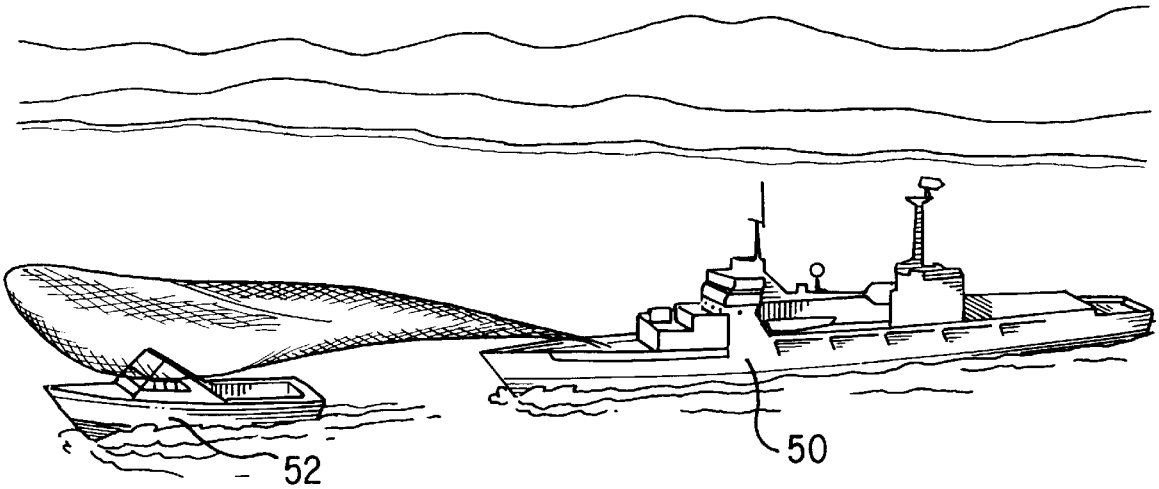
FIG. 4 is a view of a net in an intermediate stage of deployment from a command vessel over a target vessel.
Figure 6:
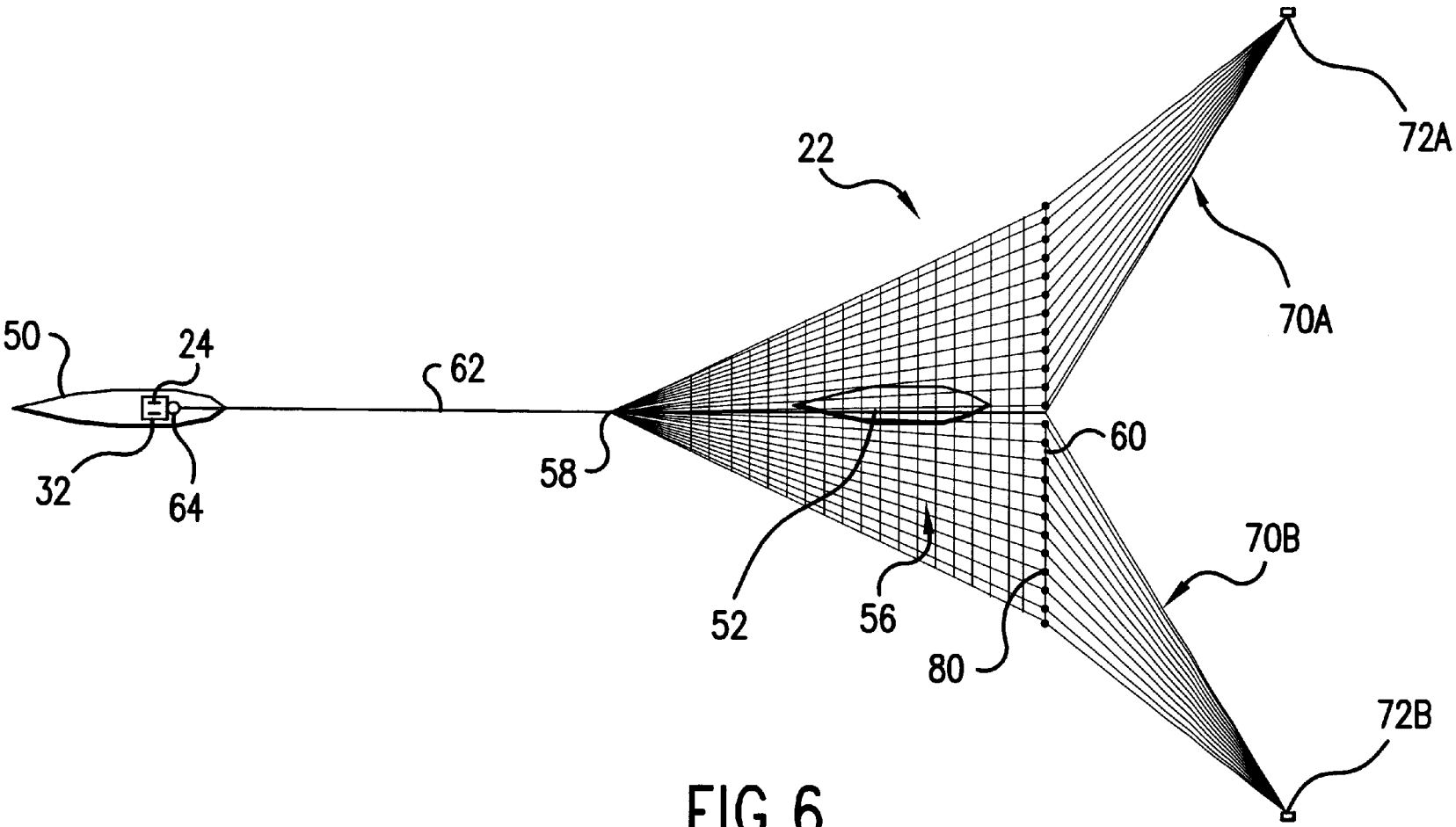
FIG. 6 is a top view of an intermediate stage in deployment of a net over a target vessel.

The craft interface kit contains the hardware necessary to install the system on a particular command or capture vessel 50 (FIG. 4). FIG. 4 also shows a target vessel 52 which is typically much smaller than the command vessel. FIG. 6 shows the net 22 deployed over the target vessel by the command vessel. The exemplary unfurled net 22 has a main net portion 56 diverging distally in a generally triangular form from a proximal vertex 58 to a distal leading edge 60. A tether or tension line 62 in the restraint system connects the net to a winch 64 which may be electrically powered and may be integrated with or located adjacent to the launch rail system.

At its leading edge, the main net portion is connected to left and right harness wings 70A and 70B. The harness wings contain a number of elements extending from the net leading edge to an associated left and right rocket motor 72A and 72B. At various locations along the net leading edge, an array of weights 80 may be provided.

Figure 2:
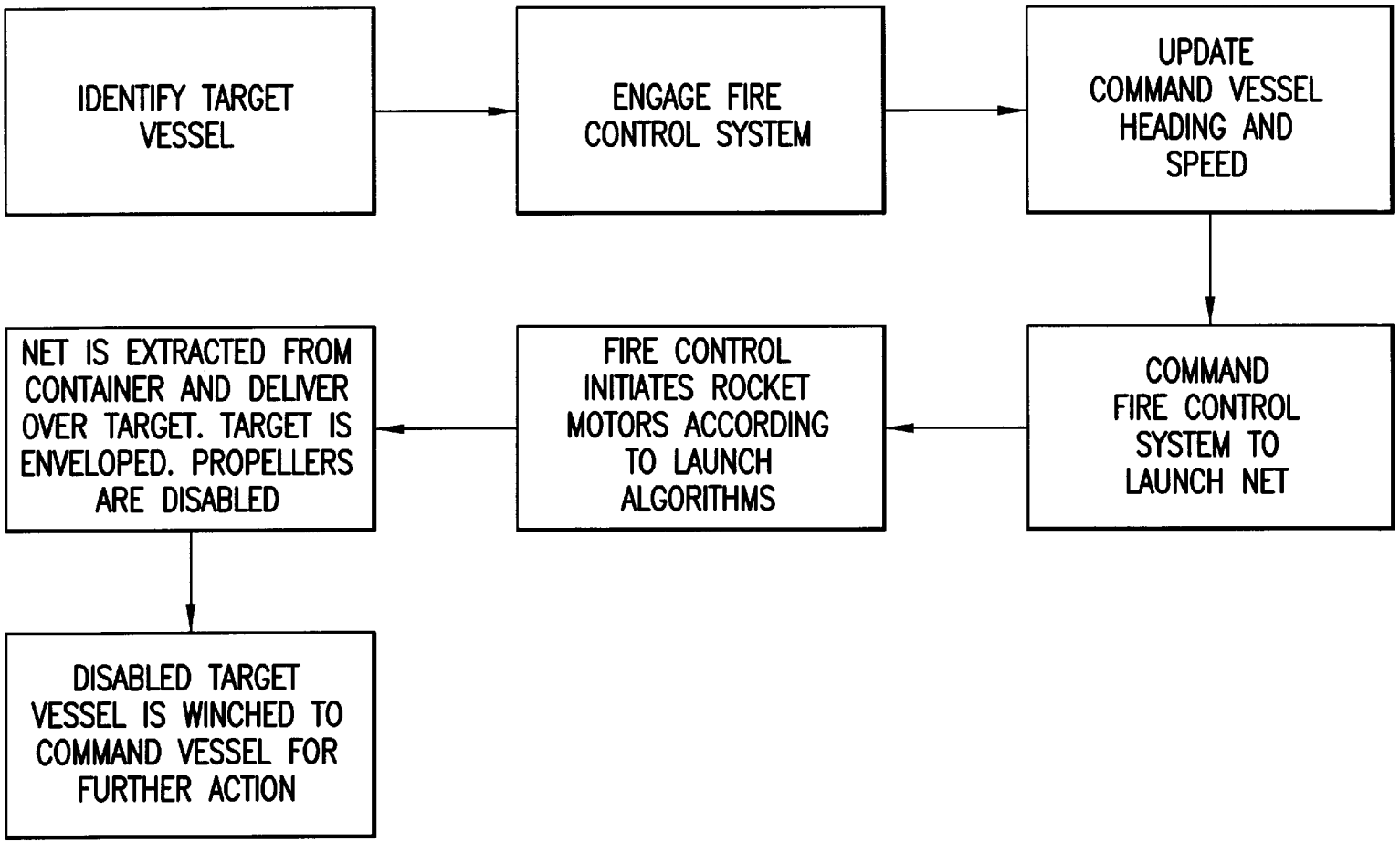
FIG. 2 is an operational sequence flow chart of an exemplary vessel capture system.
Figure 3:
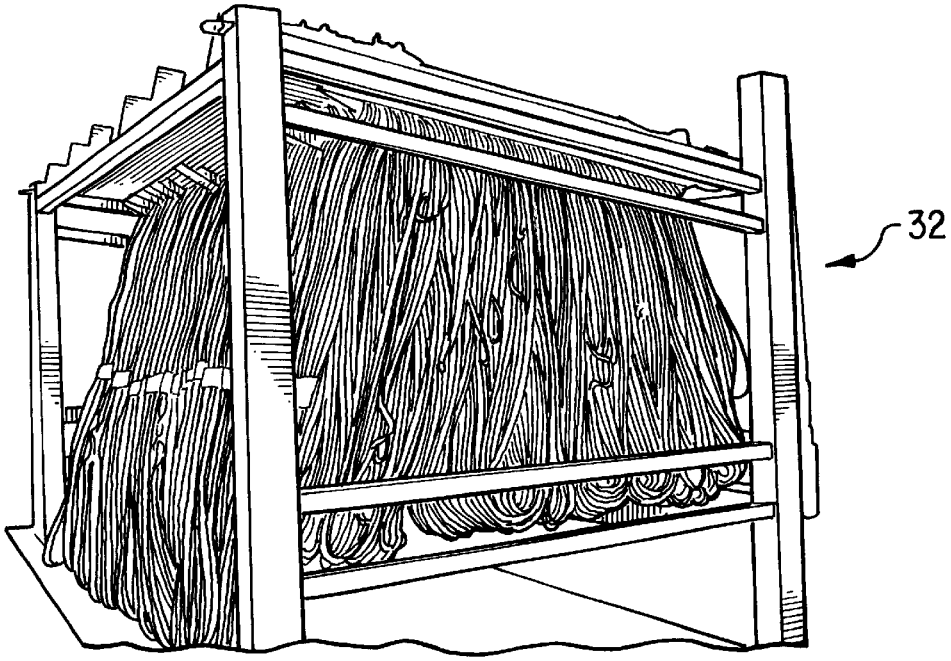
FIG. 3 is a view of structural portions of an exemplary storage and shipping container which may be adapted for use with a deployable net.

An exemplary operational sequence is shown in FIG. 2. As shown, after the target vessel is encountered and identified, the fire control system (FCS) is activated. The FCS provides feedback to the command vessel's pilot to enable him to position his vessel in position in order to launch the VCS. The FCS provides data such as required command vessel heading and speed. Once the command to launch is provided by the pilot, the fire control system will automatically fire the rocket motors when proper launch parameters are met, ensuring target vessel envelopment. The traveling rockets extract the net and deliver it over the target vessel. The net envelopes the target vessel and, preferably ensnares the vessel and entangles its propellers to further disable the vessel. The winch may then be activated to draw the target vessel toward the command vessel to allow for boarding or other actions.

Figure 5:
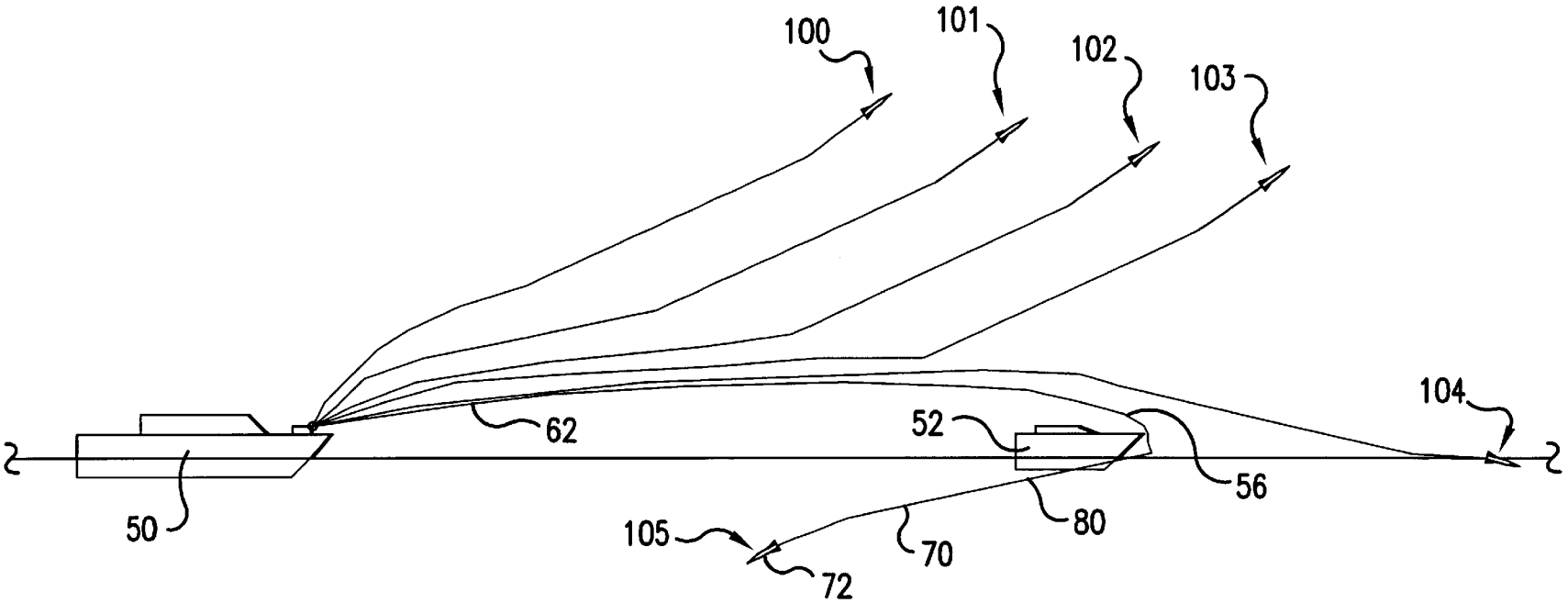
FIG. 5 is a schematic time lapse of various intermediate stages of deployment of an exemplary net.

By flying in slightly divergent paths, the rocket motors, via the harnesses, spread the net laterally in addition to longitudinally (FIG. 6). Exemplary details of vessel envelopment are disclosed in the sequence view of FIG. 5. The view of FIG. 5 reflects an exemplary frame of reference of the command with both the command and target vessels moving at a given velocity from left to right. The rocket motors are collectively referenced as 72 and the harness wings as 70. Of the six illustrated stages, shown by numerals 100, 101, 102, 103, 104 and 105 referencing rocket motor position, the first four involve progressive stages in rocket flight propelling the net. The fifth stage shows the rocket motors falling into the water. Due to the density of the rocket motors and to the density of weights on the harness connecting the rockets to the net or on a distal portion of the net, the net sinks, allowing the velocity of the target vessel to cause the target vessel to override the net as shown in the sixth stage. Once overridden, the net may become entangled in the target vessel's propellers, causing shutdown of the target vessel's engine.

The containment net is preferably constructed of lightweight, high-strength materials to enable rocket motor or ballistic slug deployment and vessel capture and to be capable of enveloping the target vessel and preventing target vessel propulsion. The net size may be optimized for target vessel capture. The net, being significantly larger than the target vessel is deployed over such vessel. The ballistically dense rocket motors will sink upon impacting the water. This causes the forward section of the harness and array to hang down in the water column. As the target vessel attempts to escape, the harness lines and array will then become wrapped around the vessel's hull and, if present, tangled in the propeller. This will cause the propeller to cease motion, rendering the target vessel unable to continue motion. The net size will advantageously be a minimum of 250 ft (76 m) wide by 250 ft (76 m) long and will likely have a weight of 1000 to 3000 lbs (450 to 1360 kg), depending on target vessel requirements. Nets of this size have been successfully deployed from surface craft in distances in excess of 1500 ft (460 m).

Exemplary material for the net is aramid fiber reinforced with a core of stainless steel cable. The cable provides the net with additional toughness to resist abrasion and damage such as that caused by entanglement with a target vessel propeller. The tether material may be aramid fiber or similarly reinforced aramid fiber or may be formed of a relatively elastic material.

The integrated launch rail system may be used to support the rocket motors prior to launch and provide for desired rocket motor path during extraction. This system may provide for the adjustment of quadrant elevation and azimuth angle for required mission settings. The launch rail components will advantageously be suited for long-term exposure to salt air. The reusable launch rail system will advantageously be provided with a complete inventory of spare parts. Each launch rail may be an exemplary 5 feet (1.5 m) long and is supported by a framework that interfaces with the shipping container and craft interface kit.

The fire control system will advantageously provide the capability to accurately deploy the containment net from the command vessel while experiencing pitch, roll, yaw, heave, sway, and forward motion. Using sophisticated motion platforms for testing and algorithm development, computer codes, and instrumentation, this type of fire control system has been demonstrated as an effective accurate means of deploying nets using unguided solid propellant rocket motors. The system will rely upon motion sensors, tailored deployment algorithms, and a display unit for the command vessel. The fire control system will advantageously be self-supporting and will not rely on command ship resources other than electrical power.

Depending on desired range, air guns or solid propellant rocket motors can be used to extract the net and delivery it over the target vessel. MK 22 MOD 4 rocket motors may be used at least for purposes of a demonstration test. These motors are fully qualified for use on US Navy vessels and have passed all required explosive safety tests. Having been used to extract and deploy nets, these rocket motors are a low-risk approach to net propulsion. They can be safety operated in temperatures ranging from −40° to +120° F. (−40° to +49° C.). Two launch lugs on each motor interface with the launch rail system. The rocket motors will provide adequate thrust to extract the net at speeds typically in excess of 200 ft/sec (61 m/sec). The entire event, from extraction to deployment over the target vessel is expected to take no more than 5 seconds.

The craft interface kit (CIK) provides for all required interfaces between the command vessel and the VCS. It includes mounting hardware, electrical connections, and special tools (if any).

The deployable portions of the VCS are advantageously loaded into the storage and shipping container providing protection during transportation and storage. It also serves as the support structure from which the net is deployed. Environmental protection is provided in this reusable container. The net is hung from the roof of the container. The installation loops are disengaged during net extraction and allow for high-rate reliable deployment. The SSC preferably weighs approximately 500 lbs (227 kg) and is approximately 8×5×4 ft (2.4×1.5×1.2 m) high.

While the containment net alone will preferably be able to limit the target vessel's ability to navigate, a winch system is preferably used to provide additional control. A tension line or tether will be attached to the aft (proximal) end of the containment net. This tether will be attached to a winch installed on the command vessel. As desired, the target vessel can be winched toward the command vessel for subsequent boarding or other operations.

Target vessel attributes such as weight, length, speed, and depth considerations must be understood and characterized and will influence any particular implementation. Target vessel studies will allow development of a system requirements document (SRD) to be used in optimization studies to assure that the system provides required functionality for the particular application (types of target and capture vessels, speeds and water conditions, etc.). The SRD may provide a roadmap for follow-on analysis, design optimization, and test efforts.

Understanding and predicting the dynamic loading characteristics of deployable VCS components is advantageous before a structurally appropriate design is developed. In addition, the inter-relationship between important parameters such as range, net spread at impact, the effects of craft motion on accuracy, quadrant elevation, azimuth angle, net weight, and rocket motor thrust must be clearly understood and studied. Computer analysis tools have been developed for solving such deployment analysis problems.

Various rocket motor-deployed mine counter measures (MCM) Systems have been developed over the past ten years. In support of these efforts, computer simulation techniques have been developed and implemented.

The Automatic Dynamic Analysis of Mechanical Systems (ADAMS) code (Mechanical Dynamics, Inc., Ann Arbor, Mich.) may be used to analyze all important deployment characteristics. The ADAMS code has been used to model the deployment characteristics of several net systems with great success. A six degree of freedom representation of the VCS may be used to solve for component acceleration, velocity, position, and internal loading during. deployment. A verified baseline net deployment model may be made available for the minor modifications as required by the target vessel set. This baseline model may also be used to conduct parametric studies to support fire control algorithm development. This model is believed capable of accommodating all environmental conditions such as heave, sway, pitch, roll, yaw, and wind. The rocket motor, containment net, winch system, connectors, and harness, may be represented using the ADAMS 6-DOF code. The bridle may be represented by a number of bridle segments. Special attention may be paid to modeling the harness and high load areas to allow for accurate load and acceleration predictions at these components. The rocket motor and bridle representation may allow for rocket motor rotation and translation in response to loads exerted by the payload. Since the payload exerts rotational forces that induce rocket motor pitching and yawing, this representation is useful to accurately predict system trajectory. The simulated launch configuration will preferably match one-for-one the actual pre-launch configuration.

ADAMS models a mechanical system by solving the following first order Euler-Lagrange equations:
where:

$$m_i a_i - Fi - \sum_{j=1}^{m} Rfj\ \Phi j/xi = 0 \qquad \frac{dxi}{dt} - Vi = 0 \qquad \Phi j = 0$$

$i = 1, 2, 3 \ldots n$ $\qquad$ $j = 1, 2, 3 \ldots m$ $m_i$ = mass of the $i$th coordinate $\qquad$ $a_i$ = acceleration $x_i$ = displacement of $i$th coordinate $\qquad$ $V_i$ = velocity $F_i$ = sum of applied forces acting on the $i$th coordinate $Rf_j$ = reaction force for the $j$th coordinate Initial conditions, backward differencing formula (BDF), and the Euler-Lagrange equations define the initial value problem (IVP) in ADAMS. ADAMS employs a multi-step predictor-corrector method to solve the IVP that improves accuracy made by explicit methods alone, such as the Runge-Kutta method of four. With the predictor-corrector method, an explicit method predicts an approximation to the solution and implicit method corrects this prediction. Additionally, ADAMS employs a variable step-size algorithm to further reduce integration error.

The predictor applies a BDF to each unknown in the system to provide an initial guess for the corrector. The corrector is a modified Newton-Raphson algorithm that solves the Euler-Lagrange equations and the BDF equations. The self-formulating ADAMS code requires the input of mass properties, dynamic material properties, initial position, and aerodynamic properties.

A 3-D aerodynamic representation of the system may be used to predict flight characteristics of the system. Aerodynamic lift and drag as a function of angle of attack and velocity will be included. The aerodynamic coefficients of the grenades, rocket motor, and fuzes will be based on theoretical data unless wind tunnel data is available.

Aerodynamic forces will be implemented assuming the following:

$$\text{Drag} = \tfrac{1}{2} Cd \rho \text{area} V^2$$

$$\text{Lift} = \tfrac{1}{2} Cl \rho \text{area} V^2$$

where:

Drag=force normal to apparent velocity (lbf or n)

Lift=force tangent to apparent velocity (lbf or n)

Cd=coefficient of drag, as a function of angle of attack

Cl=coefficient of lift, as a function of angle of attack

ρ=air density (slug/ft$^3$ or kg/m$^3$)

area=reference area (ft$^2$ or m$^2$)

V=apparent velocity (ft/sec or m/s)

Time varying rocket motor performance may be accounted for in the VCS deployment model. Worst-case rocket motor performance, yielding the highest dynamic loads, may be assumed. Rocket motor performance data may be taken from static firings and theoretical calculations.

Results from this analysis effort may also be used to develop fire control algorithms.

The greatest challenge in deploying a net from a small surface craft is accounting for potential craft motion while the rocket motors are travelling along the launch rails. Once the rocket motors have separated from the launch rails, craft motion has little impact on system trajectory. The fire control will advantageously incorporate a system of sensing craft 6-DOF motion and provisions made to account for the impact of launch rail position and motion effects on rocket motor trajectory.

One or more embodiments of the present invention have been described. Nevertheless, it will be understood that various modifications may be made without departing from the spirit and scope of the invention. For example, the nature of the target vessel and its capture environment will significantly influence preferred construction details. Accordingly, other embodiments are within the scope of the following claims.

What is claimed is:

1. A system for permitting a first surface vessel to capture a second surface vessel comprising:

a net having an initial stowed condition;

a launcher for projecting the net from the stowed condition to a deployed condition ensnaring the second vessel at a first location and comprising:

first and second chemical rockets; and a harness system coupling the first and second rockets to a distal portion of the net;

a winch; and at least one tension line coupling the net to the winch.

2. The device of claim 1 wherein the net generally increases in width from a proximal portion to a distal portion in an unfurled condition.

3. The device of claim 2 wherein the harness includes left and right portions, coupled to the first and second rockets respectively and distributing force applied by said rockets over a substantial portion of a net leading edge.

4. The device of claim 3 wherein the net leading edge bears a plurality of weights having a specific gravity substantially in excess of 1, effective to cause sinking of a distal portion of the net.

5. The device of claim 1 wherein the net carries no explosive material.

6. The device of claim 5 wherein the net is reusable after deployment.

7. The device of claim 6 wherein in its stowed condition, the net is suspended within a storage container.

8. The device of claim 1 wherein the net comprises aramid fiber reinforced with stainless steel cable.

9. A method for the capture of a target water-borne vessel by a second water-borne vessel comprising:

providing on the second vessel a deployable net system including:

an initially stowed net;

at least two chemical rockets coupled to the net;

a winch; and a tension line coupling the net to the winch;

launching the two chemical rockets to deploy the net over the target vessel in a first location; and causing the winch to draw in the tension line and pull the target vessel toward the second vessel.

10. The method of claim 9 further comprising:

permitting a portion of the net located distally of the target vessel to sink so as to enhance entanglement of the target vessel in the net;

permitting the target vessel to move from the first position and override a portion of the sunken portion of the net; and permitting the overridden portion of the net to entangle and stop a propeller of the target vessel.

11. The method of claim 9 further comprising:

returning the net to its stowed condition;

unwinding the tension line from the winch; and replacing or refueling the rockets.

12. The method of claim 9 further comprising:

permitting a portion of the net located distally of the target vessel to sink into the water on which the target vessel is borne so as to enhance entanglement of the target vessel in the net.

13. The method of claim 9 further comprising:

permitting the target vessel to move from the first position and override a sunken portion of the net; and permitting the overridden portion of the net to entangle and stop a propeller of the target vessel.

14. A system for permitting a first surface vessel to capture a second surface vessel comprising:

a net having an initial stowed condition and generally increases in width from a proximal portion to a distal portion in an unfurled condition;

a launcher for projecting the net firm the stowed condition to a deployed condition ensnaring the second vessel at a first location and comprising:

first and second chemical rockets; and a harness system coupling the first and second rockets to a distal portion of the net and including left and right portions, coupled to the first and second rockets respectively, and distributing force applied by said rockets over a substantial portion of a net leading edge;

a winch; and at least one tension line coupling the net to the winch.

15. The system of claim 14 wherein the net leading edge bears a plurality of weights having a specific gravity substantially in excess of 1, effective to cause sinking of a distal portion of the net.

* * * * *